US007472892B2

(12) United States Patent
Paa

(10) Patent No.: US 7,472,892 B2
(45) Date of Patent: Jan. 6, 2009

(54) CARBURETOR OF AN INTERNAL COMBUSTION ENGINE

(75) Inventor: Andreas Paa, Winnenden (DE)

(73) Assignee: Andreas Stihl AG & Co. KG (DE)

( * ) Notice: Subject to any disclaimer, the term of this patent is extended or adjusted under 35 U.S.C. 154(b) by 266 days.

(21) Appl. No.: 11/489,763

(22) Filed: Jul. 20, 2006

(65) Prior Publication Data

US 2007/0023934 A1 Feb. 1, 2007

(30) Foreign Application Priority Data

Aug. 1, 2005 (DE) ..... 10 2005 036 091

(51) Int. Cl.
*F02M 7/08* (2006.01)

(52) U.S. Cl. ..... 261/34.2; 261/35; 261/DIG. 81

(58) Field of Classification Search ..... 261/34.2, 261/35, DIG. 81, DIG. 83
See application file for complete search history.

(56) References Cited

U.S. PATENT DOCUMENTS 6,595,500 B2 * 7/2003 Osburg et al. ..... 261/34.2
6,676,114 B2 * 1/2004 Gerhardy ..... 261/34.2
7,000,906 B2 * 2/2006 Geyer et al. ..... 261/34.2
2002/0158349 A1 * 10/2002 Osburg et al. ..... 261/34.2
2002/0163087 A1 * 11/2002 Gerhardy ..... 261/34.2
2004/0256744 A1 * 12/2004 Geyer et al. ..... 261/35

FOREIGN PATENT DOCUMENTS

JP 60-75750 A * 4/1985

* cited by examiner

*Primary Examiner*—Richard L Chiesa
(74) *Attorney, Agent, or Firm*—Robert W. Becker; Robert W. Becker & Associates

(57) ABSTRACT

A carburetor of an internal combustion engine for operating a manually-guided implement, including an intake channel having a venturi section for combustion air, a fuel channel that opens into the intake channel via a fuel opening, and an accelerator pump that is in flow-conducting communication with the fuel opening. During operation of the carburetor, the fuel channel is adapted to have fuel flow continuously therethrough. The fuel channel is guided through a pump chamber of the accelerator pump.

8 Claims, 2 Drawing Sheets

CARBURETOR OF AN INTERNAL COMBUSTION ENGINE

The instant application should be granted the priority date of Aug. 1, 2005 the filing date of the corresponding German patent application 10 2005 036 091.2.

BACKGROUND OF THE INVENTION

The present invention relates to a carburetor of an internal combustion engine for operating a manually-guided implement such as a chain saw, a brush cutter, or the like.

Manually-guided implements such as chain saws, brush-cutters, or the like are subjected during operation to changing environmental conditions under which the internal combustion engine, as a drive engine, must operate cleanly at various temperatures, vibration loads, or the like. In addition to a clean running at uniform load and speed, it is also desirable to have a good operating characteristic during start up and during sudden supplies of gas, i.e. during accelerations.

To supply the internal combustion engine with a fuel/air mixture, a carburetor is provided with which a stream of combustion air is drawn in through an intake channel having a venture section of the carburetor. An underpressure exists in the venture section that draws fuel through a fuel channel and fuel openings that open into the intake channel. The fuel that is drawn in is atomized in the combustion air stream, thus forming the fuel/air mixture that is necessary for combustion. The formation of fuel/air mixture must also be adapted with an as exact proportioning as possible to different operating situations.

A main nozzle arrangement having a fuel opening in the venturi section and an associated main nozzle section of the fuel channel is provided for full throttle operation. Provided in the region of a butterfly valve are one or more further fuel openings as part of an idling nozzle arrangement; with the butterfly valve at least partially closed, these further fuel openings contribute to a clean mixture formation. When the butterfly valve is opened in an abrupt manner for sudden acceleration of the internal combustion engine, a brief leaning of the mixture is observed that can lead to the engine dying out or at least to an impairment of the exhaust gas or emission values. To avoid this drawback, with heretofore known carburetors an accelerator pump is provided having a piston that is movably guided in a pump chamber and that is coupled with the position of the butterfly valve. The pump chamber is filled with fluid. When the butterfly valve is opened, the piston moves and presses fuel out of the pump chamber, as an additional quantity of fuel, through one of the aforementioned fuel openings into the intake channel. The thereby effected temporary enrichment of the mixture permits a clean speeding up of the engine.

It has been shown that vapor bubbles can form in the fuel system of the carburetor, with such bubbles making a precise metering of the drawn-in fuel more difficult. In particular, difficult starting of the internal combustion engine has been observed. To remove vapor or air bubbles from the fuel system, venting arrangements are known that are also designated as purges. Prior to starting the internal combustion engine, fuel is pumped out of the carburetor and back into the tank with a rubber-like bellows, while fresh fuel subsequently flows out of the tank into the carburetor. Bubbles found in the carburetor are flushed out.

However, it has been shown that despite the aforementioned measures, the mixture formation is not always satisfactory during operation. Under certain operating conditions, deviations from the optimum fuel/air ratio, with corresponding fluctuations in the emission values, have been observed.

It is therefore an object of the present invention to improve a carburetor of the aforementioned general type in such a way that the reliability of the mixture formation that is provided is improved.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
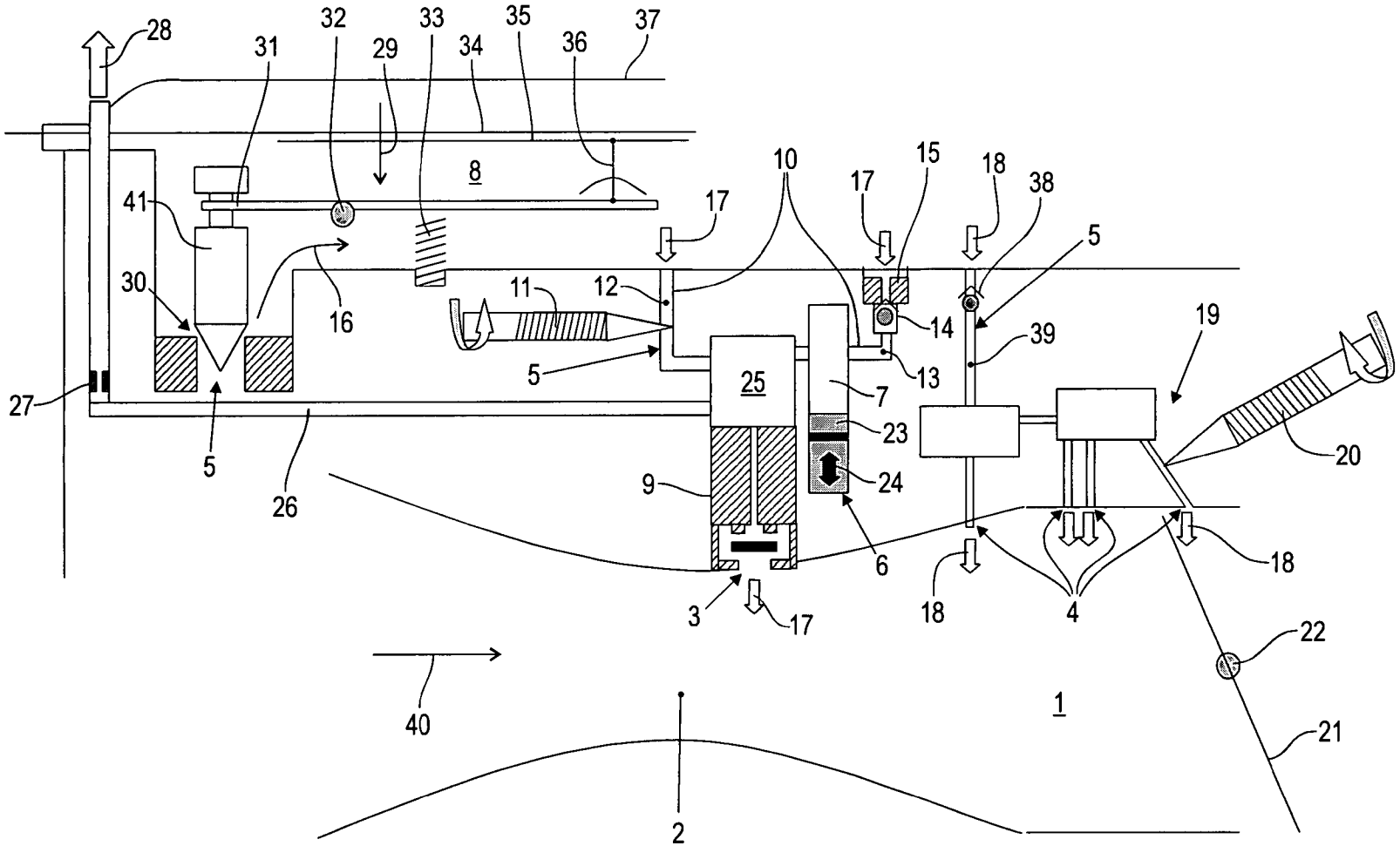
FIG. 1 is a longitudinal cross-sectional illustration of an inventive carburetor, by way of example a diaphragm carburetor, having a main nozzle section of the fuel channel divided into two partial channels, and having an accelerator pump arranged in one of the two partial channels.

The carburetor of the present application comprises an intake channel having a venture section for combustion air; a fuel channel that opens into the intake channel via a fuel opening; and an accelerator pump that is in flow-conducting communication with the fuel opening, wherein during operation of the carburetor the fuel channel is adapted to have fuel flow continuously there through, and wherein the fuel channel is guided through a pump chamber of the accelerator pump.

The carburetor is preferably a diaphragm carburetor having a diaphragm-controlled regulating chamber, whereby the pump chamber is disposed in the fuel channel downstream of the regulating chamber. The associated fuel opening is in particular part of the main nozzle arrangement for full throttle operation and opens into the venture section, whereby a main nozzle section of the fuel channel extends into the main nozzle arrangement, and whereby the main nozzle section is guided through the pump chamber of the accelerator pump.

The present invention is based on the recognition that vapor bubbles can form in the fuel system of the carburetor not only when the engine is shut off but also during operation, which can then not be flushed out by actuating the purer prior to the start up process. Such gas bubbles can collect, or can grow after being formed, in regions of the fuel path that are not subjected to a permanent flow-through as a result of operation. In particular in the pump chamber of the accelerator pump gas bubbles result from the evolution of gas as a consequence of vibrations or due to the under pressure that results with each change in load during filling of the accelerator pump. These gas bubbles tend to surge and cause great CO fluctuations in the exhaust gas. Guiding a fuel channel that has fuel flow continuously therethrough during operation through the pump chamber of the accelerator pump subjects the pump chamber to a continuous flushing during operation. Thus, the formation of gas bubbles is avoided. Gas bubbles that nonetheless form are flushed out right at the beginning, before they have achieved a disruptive magnitude. In particular when the throttle is opened, during which the contents of the pump chamber are pressed into the intake channel, a considerable improvement in precision and reproducibility of the fuel/air ratio that is provided can be observed. Running of the engine and emission values are reliably improved.

Pursuant to a preferred embodiment, a main adjusting screw is provided in the main nozzle section, whereby the pump chamber is disposed upstream of the main adjusting screw. As a dual function, in addition to the full load mixture for continuous operation, the main adjusting screw thus also influences the fuel quantity that is additionally introduced by the accelerator pump during opening of the throttle. It can also be expedient to dispose the pump chamber downstream of the main adjusting screw in the main nozzle section, whereby the pump quantity is not influenced by the position of the main adjusting screw.

Pursuant to a preferred variation, the main nozzle section is divided into two partial channels that are connected in parallel, whereby the main adjusting screw is provided in the first partial channel, and the pump chamber is disposed in the second partial channel without the main adjusting screw. The quantity that flows through the first partial channel can be variably adjusted by means of the main adjusting screw, while the quantity that flows through the second partial channel remains essentially constant. The adjustment effect of the main adjusting screw is improved. At the same time, there is ensured that the pumping and flushing effect of the accelerator pump is not influenced by the position of the main adjusting screw.

A check valve is expediently provided upstream of the accelerator pump; this check valve is in particular connected directly with the regulating chamber. Upon actuation of the accelerator pump, the check valve closes and ensures that the pump quantity that is provided does not pass back into the regulating chamber, but rather passes entirely into the intake channel. The direct connection with the regulating chamber permits easy installation or removal when the regulating chamber is opened.

Further specific features of the present application will be described in detail subsequently.

DESCRIPTION OF SPECIFIC EMBODIMENTS

Referring now to the drawings in detail, FIG. 1 shows a schematically illustrated carburetor, by way of example a diaphragm carburetor, for an internal combustion engine for operating a manually-guided or portable implement. During operation, the non-illustrated internal combustion engine draws in combustion air in the direction of the arrow 40 through an intake channel 1 of the carburetor. Formed into the intake channel 1 is a venture section 2 that in a rounded manner narrows the flow cross-section. A main nozzle arrangement 9 having a fuel opening 3 is provided approximately at the narrowest cross-section of the venture section 2. Fuel is drawn into the intake channel 1 through the fuel opening 3 in the direction of the arrow 17 due to the under pressure that exists in the venture section 2 as a result of operation. To control the power of the internal combustion engine, provided downstream of the venture section 2 is a throttle or butterfly valve 21, which is pivotable about a pivot axis 22. In the illustrated embodiment, the butterfly valve 21 nearly completely closes off the flow cross-section of the intake channel 1 and is thus shown in the idling position. In the full throttle position, the butterfly valve 21 is pivoted about the pivot axis 22 in such a way that it is disposed approximately parallel to the longitudinal axis of the intake channel 1, i.e. to the direction of flow 40, and entirely opens the cross-section of the intake channel 1. In addition to the main nozzle arrangement 9 having the associated fuel opening 3, an idling nozzle arrangement 19 having a plurality of fuel openings 4 is provided in the region of the butterfly valve 21; during operation, fuel enters the intake channel 1 through the fuel openings 4 as shown by the arrows 18. The idling nozzle arrangement 19, preferably when the butterfly valve 21 is closed, ensures the formation of a fuel/air mixture in the intake channel 1 that is necessary for idling.

To supply the illustrated arrangement with fuel, the carburetor is provided with a fuel channel 5 that conveys fuel from a non-illustrated tank through a diaphragm valve 30 in the direction of the arrow 16, into a regulating chamber 8, and from there, in the direction of the arrows 17 and 18, through the main nozzle arrangement 9 or the idling nozzle arrangement 19 into the intake channel 1. The regulating chamber 8 is part of the fuel channel 5. To control the flow of fuel, an elastic diaphragm 34 is provided that tightly closes the regulating chamber 8. Toward the outside, the diaphragm 34 is covered by a cover 37. Present between the cover 37 and the diaphragm 34 is a reference pressure, which can be the ambient pressure or some other suitable reference pressure, such as from the non-illustrated intake air filter or the like.

Transverse to its plane, in the direction of the arrow 29, the diaphragm 34 can be deflected elastically, and is connected with a pressure plate 35. By means of a schematically indicated connection 36, the pressure plate 35 acts upon a lever 31 that is disposed in the regulating chamber 8 and is mounted so as to be pivotable about a pivot axis 32 against the force of a compression spring 33. On that side that is opposite the connection 36, a valve body 41, which is part of the diaphragm valve 30, is disposed on the lever 31. If fuel is removed from the regulating chamber 8 by the main nozzle arrangement 9 and the idling nozzle arrangement 19, the reduced volume resulting in the regulating chamber 8 causes the diaphragm 34, together with the pressure plate 35 and the connection 36, to be moved in the direction of the arrow 29, whereby the lever 31 effects a raising of the valve body 41 counter to the direction of the arrow 29. The diaphragm valve 30 is consequently open, and fresh fuel can subsequently flow through the diaphragm valve 30 in the direction of the arrow 16. To feed the fuel into the regulating chamber 8, the carburetor can have a diaphragm pump or the like, which to facilitate illustration is not shown. The diaphragm valve 30, which is controlled by the diaphragm 34, ensures that only that quantity of fuel is subsequently conveyed into the regulating chamber 8 that is also removed by the fuel openings 3 and 4 into the intake channel 1.

A first partial stream of the fuel passes out of the regulating chamber 8 in the direction of the arrow 18 through a check valve 38 into an idling nozzle section 39 of the fuel channel 5, and from there passes to the idling nozzle arrangement 19, where it enters the intake channel 1 from the associated fuel openings 4 in the direction of the arrow 18. For this purpose, the idling nozzle arrangement 19 has a plurality of partial channels of the idling nozzle section 39 that are connected in parallel to one another, and one of which has a cross-section that can be controlled by an idling adjusting screw 20. By means of the idling adjusting screw 20, the fuel/air mixture for idling can be set to the desired ratio.

A further partial stream of the fuel passes out of the regulating chamber 8 through a main nozzle section 10 of the fuel channel 5 to the main nozzle arrangement 9, and from there through the associated fuel opening 3 into the venture section 2 of the intake channel 1. In the illustrated embodiment, for this purpose the main nozzle section 10 of the fuel channel 5 is divided into two partial channels 12, 13 that are connected in parallel to one another and that both open into a main nozzle chamber 25 of the main nozzle arrangement 9, where they are joined together. The first partial channel 12 has a cross-section that can be adjusted by a main adjusting screw 11, while the further partial channel 13 does not have its flow characteristics influenced by a flow control device 15 of constant cross-section. A fixed basic quantity of fuel passes in the direction of the arrow 17 through the second partial channel 13, while an auxiliary quantity of fuel flows in the direction of the arrow 17 through the partial channel 12, whereby its quantity can be adjusted by means of the main adjusting screw 11. The partial quantities of fuel that flow through the two partial channels 12, 13 are joined together in the main nozzle chamber 25 and exit out of the fuel opening 3 into the venture section 2 in the direction of the arrow 17 as a single quantity.

Disposed in the second partial chamber 13 is an accelerator pump 6 that has a pump chamber 7 with a piston 23 that is movably guided therein in the direction of the double arrow 24. The axial position of the piston 23 is coupled to the pivoted position of the butterfly valve 21. With the idling position of the butterfly valve 21 illustrated here, the piston 23 is disposed in a position in which the fuel-filled volume of the pump chamber 7 is at a maximum. Upon opening of the butterfly valve 21 in the direction of the full throttle position, the piston 23 is moved in such a way that the fuel-filled volume of the pump chamber 7 is reduced. In conformity with the movement position of the piston 23, an associated quantity of fuel from the pump chamber 7 is pressed through the second partial channel 13 and the main nozzle arrangement 9 out of the associated fuel opening 3 and into the venture section 2 of the intake channel 1, thereby bringing about a desired enrichment of the fuel/air mixture upon opening of the butterfly valve 21.

Disposed between the pump chamber 7 and the regulating chamber 8 is a check valve 14 that upon actuation of the accelerator pump 6 prevents a backflow of the fuel quantity from the pump chamber 7 back into the regulating chamber 8. In the illustrated embodiment, the check valve 14 is a component that is integrated with the flow control device 15 and is disposed directly at the intake side of the second partial channel 13 where it opens into the regulating chamber 8 without the influence of an upstream adjusting screw or the like. The structural component composed of the flow control device 15 and the check valve 14 can be installed or removed by removing the cover 37 and the diaphragm 34 from the regulating chamber 8.

A venting line 26 having a flow control device or restrictor 27 is provided for venting the fuel system prior to starting up a non-illustrated internal combustion engine. The venting line 26 opens into the main nozzle chamber 25 and is connected in a flow-conducting manner with the two partial channels 12, 13 of the main nozzle section 10 and with the pump chamber 7 of the accelerator pump 6. By actuating a non-illustrated purer, fuel can be drawn off out of the venting line 26 in the direction of the arrow 28, whereby fresh fuel from the regulating chamber 8 can subsequently flow into the main nozzle section 10 of the fuel channel 5. The second partial channel 13 is guided through the pump chamber 7. Gas bubbles that might form in the pump chamber 7 in the main nozzle chamber 25 are flushed out in the direction of the arrow 28. After the internal combustion engine has been started, permanent fuel is drawn into the intake channel 1 through the fuel openings 3, 4. During operation, fuel permanently flows through the fuel channel 5, including its main nozzle section 10 and its idling nozzle section 39. By passing fuel in the second partial channel 13 through the pump chamber 7, the pump chamber 7, even without actuation of the piston 23, also has fuel continuously flowing through it, i.e. is continuously flushed with fuel, as a result of which no gas bubbles form here nor can they even settle.

Figure 2:
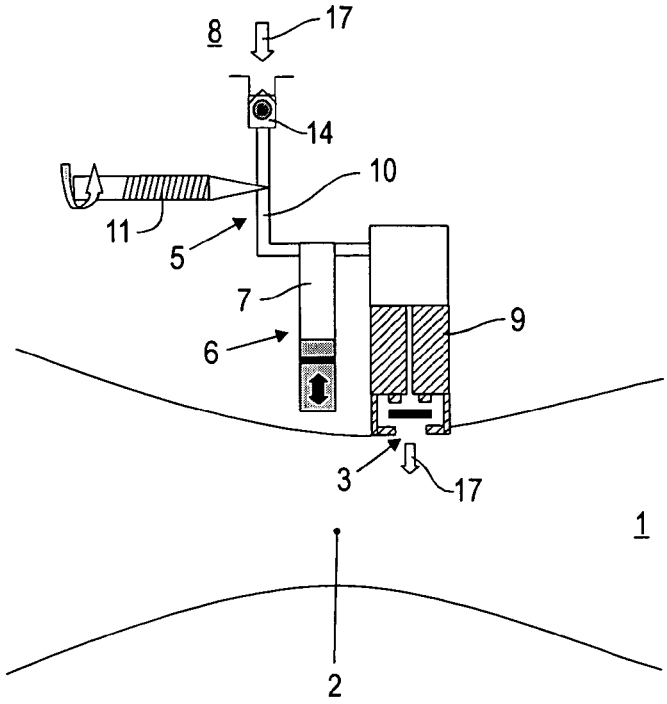
FIG. 2 shows a variation of the arrangement of FIG. 1 in which the accelerator pump is disposed downstream of the main adjusting screw.

FIG. 2 shows a partial view of a variation of the arrangement of FIG. 1, with the accelerator pump 6 being disposed in that portion of the main nozzle section 10 of the fuel channel 5 that has permanent flow there through during operation and the cross-section of which can be adjusted by the adjusting screw 11. With this embodiment, fuel first flows in the direction of the arrow 17 out of the regulating chamber 8 through a check valve 14, from there through the main nozzle section 10 past the adjusting screw 11 and through the pump chamber 7 of the accelerator pump 6 into the main nozzle arrangement 9, from where the fuel enters through the associated fuel opening 3 into the venture section 2 of the intake channel 1. The pump chamber 7 is disposed downstream of the adjusting screw 11 in the main nozzle section 10 between the adjusting screw 11 and the main nozzle arrangement 9.

Figure 3:
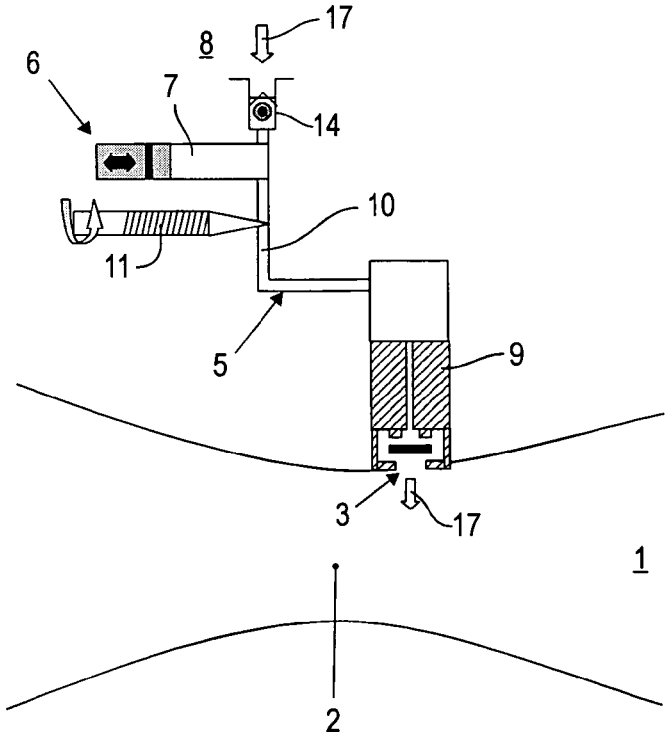
FIG. 3 shows a further embodiment having the accelerator pump disposed upstream of the main adjusting screw.

With the further embodiment of FIG. 3, the accelerator pump 10 is disposed between the check valve 14 and the adjusting screw 11; the remaining features and reference numerals are identical to the arrangement of FIG. 2. It can also be expedient with the arrangements of FIGS. 2 and 3, in conformity with the embodiment of FIG. 1, to form two partial channels 12, 13 of the main nozzle section 10, whereby the accelerator pump 6 is respectively disposed in that partial channel 12 whose cross-section can be adjusted by the adjusting screw 11. The remaining features and reference numerals of the arrangements of FIGS. 2 and 3 correspond with those of FIG. 1.

The specification incorporates by reference the disclosure of German priority document 10 2005 036 091.2 filed Aug. 1, 2005.

The present invention is, of course, in no way restricted to the specific disclosure of the specification and drawings, but also encompasses any modifications within the scope of the appended claims.

What I claim is:

1. A carburetor of an internal combustion engine for operating a manually-guided implement, comprising:

an intake channel having a venturi section for combustion air;

a fuel channel that opens into said intake channel via a fuel opening; and an accelerator pump that is in flow-conducting communication with said fuel opening, wherein during operation of said carburetor said fuel channel is adapted to have fuel flow continuously therethrough, and wherein said fuel channel, through which fuel flows continuously during operation, is guided through a pump chamber of said accelerator pump, subjecting said pump chamber to a continuous flushing during operation.

2. A carburetor according to claim 1, wherein said carburetor is a diaphragm carburetor having a diaphragm-controlled regulating chamber, and wherein said pump chamber is disposed in said fuel channel downstream of said regulating chamber.

3. A carburetor according to claim 1, wherein a main nozzle arrangement is provided for full throttle operation, wherein said fuel opening is part of said main nozzle arrangement and opens into said venturi section, wherein said fuel channel is provided with a main nozzle section that extends into said main nozzle arrangement, and wherein said main nozzle section is guided through said pump chamber of said accelerator pump.

4. A carburetor according to claim 3, wherein a main adjusting screw is provided in said main nozzle section, and wherein said pump chamber is disposed upstream of said main adjusting screw.

5. A carburetor according to claim 3, wherein a main adjusting screw is provided in said main nozzle section, and wherein said pump chamber is disposed in said main nozzle section downstream of said main adjusting screw.

6. A carburetor according to claim 3, wherein said main nozzle section is divided into two partial channels that are connected in parallel, wherein a main adjusting screw is provided in a first one of said partial channels, and wherein said pump chamber is disposed in the other of said partial channels, which is not provided with said main adjusting screw.

7. A carburetor according to claim 2, wherein a check valve is provided upstream of said accelerator pump.

8. A carburetor according to claim 7, wherein said check valve is in direct communication with said regulating chamber.

* * * * *